United States Patent [19]

Stuckert

[11] 4,047,135

[45] Sept. 6, 1977

[54] CYLINDRICAL, LINEAR, STOPLESS MERCURY SWITCH AND RELAY

[75] Inventor: Paul Edward Stuckert, Katonah, N.Y.

[73] Assignee: International Business Machines Corporation, Armonk, N.Y.

[21] Appl. No.: 637,263

[22] Filed: Dec. 3, 1975

[51] Int. Cl.[2] ..... H01H 1/08

[52] U.S. Cl. ..... 335/58; 200/214

[58] Field of Search ..... 335/58, 57, 56, 55, 335/54, 53, 52, 51, 50, 49, 48, 47; 200/214

[56] References Cited

U.S. PATENT DOCUMENTS

| | | | |
|---|---|---|---|
| 3,144,533 | 8/1964 | Donath | 335/58 |
| 3,343,110 | 9/1967 | Grobe | 335/58 |
| 3,380,006 | 4/1968 | Donath | 335/56 |

*Primary Examiner*—Harold Broome
*Attorney, Agent, or Firm*—Graham S. Jones, II

[57] ABSTRACT

A linear mercury-wetted switch is housed within a hollow, elongated, sealed, cylindrical tube having a pair of mercury-wetted, spaced contacts which can be bridged by a conforming but spaced electromagnetically driven contact element in the form of a slider or armature which slides longitudinally inside the tube on the mercury on the surfaces of the contacts. The slider has a conductive surface for closing the electrical circuit through mercury films carried on and between the surfaces of the slider and the contacts. The slider does not go to the end of the cylinder to contact the end wall. The contacts and the armature are of conforming contour of appropriate dimensions in cross-section so that they slide one within the other. The usual armature slips over the exterior of the contacts. The envelope can also be an electrode connected to the armature by a layer of mercury and the armature can ride upon the support provided by the mercury riding on the interior of the sealed tube. Fluid damping and magnetic positioning prevent end wall contact.

13 Claims, 5 Drawing Figures

CYLINDRICAL, LINEAR, STOPLESS MERCURY SWITCH AND RELAY

BACKGROUND OF THE INVENTION

1. Field of the Invention

This invention relates to electrical circuit makers and breakers of the liquid contact type with piston or plunger-like means having a unitary bridging contact function. There may be single-pole, double-throw or single-pole, single-throw embodiments. In the case of the single-pole, single-or-double-throw arrangement, the container may form at least one contact.

2. Description of the Prior Art

U.S. Pat. No. 3,240,900 of Halff et al shows a mercury switch with two aligned contact rods separated from each other by a small amount. Within the hollow chamber is located a pool of mercury and a magnetizable plunger normally floating in the pool. About the chamber is wound an actuating coil for generating a magnetic field which will drive the plunger down into the pool of mercury, thereby elevating the surface level of the mercury until it envelops the contact ends of the two rods to close the switch.

The Beausoleil et al publication entitled "Latch Relay" in the IBM Technical Disclosure Bulletin Vol. 11, No. 11, p. 1467 shows an elongated tube with a magnetically actuable switch with a colloidal suspension of an electroconductive liquid with magnetic particles in it which can be reciprocated at will under control of an external magnetic field.

Hurvitz U.S. Pat. No. 3,289,126 shows a mercury switch with a suspension of carbonyl iron particles in it and with cylindrical contact cups at opposite ends. An external magnetic field causes the mercury to bridge the magnetically and electrically inactive material between the cups.

U.S. Pat. No. 3,786,217 of Bitko shows an elongated armature slidable on a mercury film which forms electrical contacts with contacts located at the opposite ends of a cylindrical glass tube. It includes stop members to prevent collision of the contacts at the ends of the tube with the contacts on the ends of the armature, but close enough so that the gap between contacts in the closed position is bridged by mercury droplets on the confronting contacts.

It is believed that sticking of the armature in mercury switches which employ end wall contact is probably caused by insufficient spacing between the armature contact element in the end wall and the confronting stationary contact element. As a result of small spacing, growth of fibers of metal may occur. Such fibers may affix the armature to the contact.

Accordingly, it is an object of this invention to eliminate end wall contact in linear motion liquid contact switches.

Another object of this invention is to avoid close proximity between all solid metallic parts of a linear liquid contact switch.

In accordance with this invention, sticking is avoided by means of eliminating all close proximity of solid metallic parts and providing a stopping force with a magnet, pneumatic effect or a hydraulic effect which stops the armature well short of the end wall. Dimensions are selected so that sufficient clearance between the armature and the stationary contacts is maintained by relatively thick films of conducting liquid. The force for moving the armature is provided by magnetic or other linear force producing means.

In one aspect of this invention, a linear motion liquid contact switch includes an armature which slides concentrically with respect to a pair of axial contacts which are in the form of cylindrical rods.

In an alternative arrangement, an armature rod slides within two spaced contact cylinders of larger diameter than the rod.

DESCRIPTION OF THE PREFERRED EMBODIMENTS

Figure 1A:
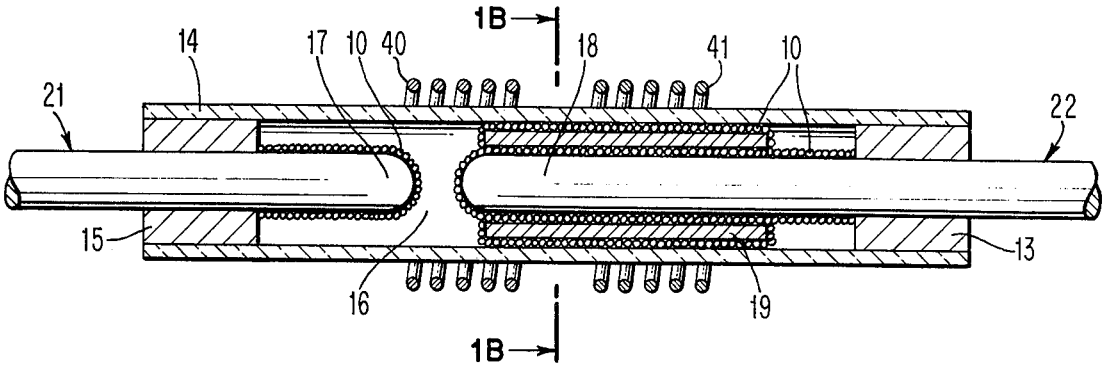
FIG. 1A is a sectional view along the length of an enclosed linear mercury-wetted single-pole, single-throw switch for an electromagnetically actuated relay.
Figure 1B:
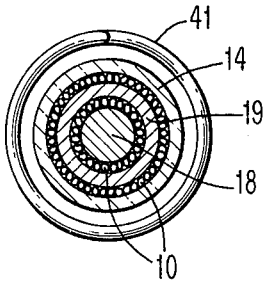
FIG. 1B is a section taken along line 1B—1B in FIG. 1A.

In FIG. 1A, a single-pole, single-throw relay is shown. A gas tight cylindrical, tubular envelope 14 partially enclosing space 16 is attached to a metallic member 13 to which a right terminal 22 of the relay is electrically and mechanically connected. Terminal 22 extends through member 13 inside space 16 terminating in contact pin 18. Envelope 14 is sealed by a gas tight glass-to-metal seal 15 at the left end which surrounds the left terminal 21 of the relay which, like terminal 22, may be of any material and shape suitable for making an electrical connection. Terminal 21 extends through seal 15, which can be metallic or glass, etc., into space 16 terminating in relay contact pin 17. Envelope 14 may be of nonmagnetic metal or glass for magnetic-or-solenoid-operated actuating means. If envelope 14 is composed of metal, member 13 and seal 15 must be composed of a dielectric such as glass.

FIG. 1A shows solenoid operating means 40 and 41 for moving the armature 19 to left or right shuttle positions as desired to close or open the single-pole, single-throw relay.

Space 16 is enclosed in a gas tight manner and is evacuated in order that armature 19 can move transversely along the length of relay contact pins 17 and 18. A vacuum is required since the spaces between armature 19 and envelope 14 and contact pins 17 and 18 are filled with liquid mercury 10 in film form, providing minimal space for displacement of gas, which, if present, would inhibit or prevent piston action. Space 16 is defined by the inside surfaces of envelope 14, seal 15, member 13, and contact pins 17 and 18. The left relay contact 17 is a solid cylindrical extension of terminal 21. The right relay contact pin 18 is a solid cylindrical extension of terminal 22. The confronting tips of contact pins 17 and 18 may be hemispherical in shape, as shown. Contact pins 17 and 18 and armature 19 have their entire surfaces wetted by mercury 10. The mercury 10 wets the surfaces of contact pins 17 and 18 and armature 19 because those parts are composed of a material which is wetted by mercury or they are coated with a surface coating material which is wetted by mercury.

Armature 19 is preferably composed of hard magnetic material for operation by electromagnetic (solenoid) or magnetic actuators or is composed of low resistance conductive material for a linear induction motor form of actuator. The armature 19, regardless of whether it is stationary or in motion, never touches or impacts any of the solid parts 13, 14, 15, 17, and 18 which bound space 16. Once in motion, armature 19 is decelerated and stopped by the influence of magnetic fields. Despite the fact that solid-to-solid mechanical contact does not occur, electrical circuit making and breaking relay action does occur, but always through the liquid films 10 on parts 17, 18, and 19. The relay is, thus, "stopless" in the usual sense.

When armature 19 moves back and forth within the envelope 14, the armature 19 is held centered radially by the surface tension forces of the mercury film.

By proper choice of the dimensions of parts 14, 17, 18, and 19, the radial length of the electrical path through the mercury film 10 between (a) parts 18 and 19 and (b) parts 17 and 19 can be controlled so that it is greater than a predetermined minimum. Prior art U.S. Pat. No. 3,644,693 teaches that the minimum length of a mercury path between two solid, metallic members should be approximately 25μm (0.001 inch) if contact sticking is to be eliminated.

Operation of the relay is straightforward, involving movement of the armature 19 from a nominal right positon to a nominal left position and the reverse. Movement of armature 19 may be effected by any of the means mentioned above. Numerous combinations of coils or of coils and permanent magnets may be used to establish latching or non-latching action. Latching action may also be achieved (in fact, it may always be present to some degree regardless of design) through the surface tension action of the mercury 10 between armature 19 and contact pins 17 and/or 18.

Figure 2A:
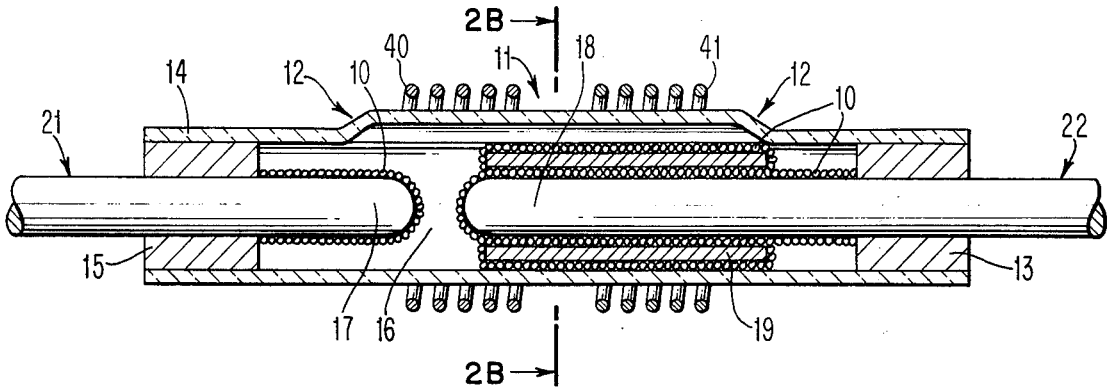
FIG. 2A is a similar view to FIG. 1A of a modified embodiment of the invention with a space provided for movement of gas within the switch enclosure of the relay.
Figure 2B:
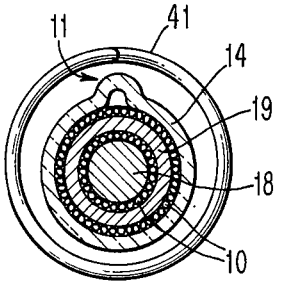
FIG. 2B is a sectional view taken along line 2B—2B in FIG. 2A.

FIG. 2A shows a relay structure having a modified cylindrical envelope 14 which includes one or more gas bypasses 11. By appropriate contouring of the bypass in the regions 12 of FIG. 2A, pneumatic cushioning and/or stopping of the motion of the armature 19 is provided. In this case, deceleration and stopping of the armature is by pneumatic action of entrapped gas in the ends of the envelope 14 and/or by the influence of magnetic fields.

The right contact 18 in FIGS. 1A and 2A is not necessary to the operation of the relay. If contact pin 18 were absent, the electrical path would be through parts 22, 13, 14, 10, 19, 10, 17, and 21 in FIG. 1A. In this version, the interior surface of envelope 14 may be coated, either entirely or in part, with a conductive material which is wetted by mercury.

Figure 3:
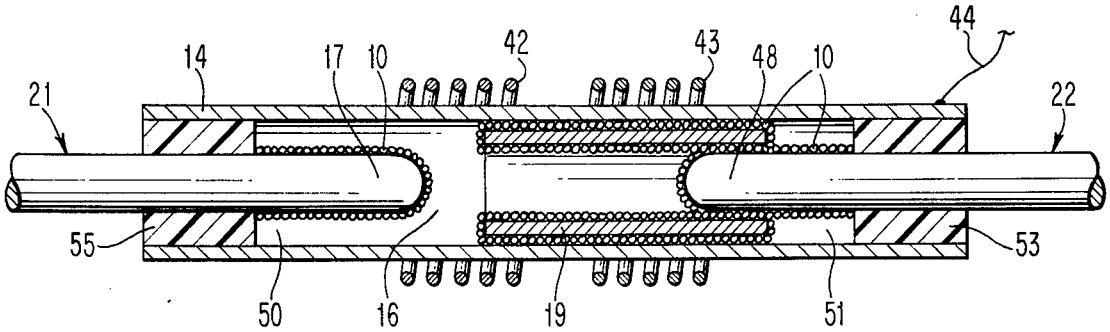
FIG. 3 is a similar view to FIG. 1A for a single-pole, double-throw relay.

FIGS. 1A and 2A show single-pole, single-throw relays. A single-pole, double-throw (SPDT) relay would be constructed as shown in FIG. 3 wherein the part designations are generally the same as those used in FIGS. 1A and 2A. As a function of the axial spacing and dimensions of contact pins 17 and 48, and armature 19, both break-before-make and make-before-break operations are possible. The common connections 44 is made to envelope 14 in FIG. 3. In this case, activating coils 42 and 43 are provided.

Pin 48 is shorter than pins 18 in FIGS. 1A and 2A to provide double-throw action. The envelope 14 can be shaped as in FIG. 2A with a bypass such as bypass 11. Alternatively, the hollow space within armature 19 may provide for gas bypass. When armature 19 reaches a point in its travel where it contacts the mercury film on a pin 17 or 48, the gas in the end space 50 or 51 of the envelope 14 is trapped and will be compressed to provide stopping action. Seals 53 and 55 are dielectric metal-to-metal seals.

Topologically, an equivalent structure is one with the stationary contacts comprising hollow cylinders within which an armature in the form of a rod or needle reciprocates or shuttles, with a layer of mercury between the contacts and the rod.

What is claimed is:

1. A fluid-conductor-wetted, linear relay switch including a housing, a stationary contact electrode within said housing, a reciprocable contact element, a conducting liquid, means for supporting said conducting liquid to provide a bearing surface of said liquid for supporting said contact element for reciprocation within said housing, said means for supporting and said liquid defining a predetermined space within which said element can reciprocate between open and closed switch positions relative to said electrode, said element and said electrode being electrically connected by said liquid when said element and said electrode are in a closed switch condition, said electrode and said element being mechanically spaced apart in all positions of said element, and said element being held apart by a predetermined minimum spacing from said electrode in said closed condition by said liquid, said element and said electrode having conforming electrical contact surfaces adapted for confrontation during sliding of said element into said closed condition, and in said closed condition said conforming surfaces resting in side-by-side overlapping relationship with said liquid contained within the space between said conforming surfaces, said conforming surfaces extending parallel to the axis of reciprocation of said reciprocable contact element.

2. A switch comprising an envelope, conducting liquid, at least two contact members each having a contact surface adapted for mutual electrical connection of said contact members through conducting liquid providing an interface between said contact members in the electrically closed position of said contact members, said contact members having conforming surfaces adapted for confrontation during sliding of said members into said electrically closed position with one of said members fitting within an interior space inside the other one of said members in said electrically closed position.

3. A switch in accordance with claim 2 wherein one of said contact members comprises a cylindrical stationary electrode, said envelope comprises a member defining a generally hollow cylindrical space and a second one of said contact members comprises a movable element which has a cylindrical surface aligned with said envelope and said one contact axially for electrical contact through said conducting liquid.

4. A switch in accordance with claim 3 wherein said one contact comprises a hollow cylinder and said second contact member comprises a cylindrical pin of smaller diameter than said one contact member.

5. A switch in accordance with claim 2 wherein one of said contact members comprises a stationary contact element having cylindrical contact surfaces, and the other of said contact members comprises a reciprocable contact element having a conforming cylindrical contact surface adapted for longitudinal sliding of said reciprocable element with its axis substantially aligned with the axis of said stationary element.

6. Apparatus in accordance with claim 5 wherein means are provided for applying a force to said contact element arresting its motion a substantial distance from end of said envelope.

7. A switch in accordance with claim 3, including a pair of stationary contact members wherein said stationary contact members comprise axially aligned pins, said switch including a housing defining a generally elongated cylindrical hollow space adapted for lengthwise reciprocation of a contact member comprising a reciprocable contact element.

8. A switch in accordance with claim 2 wherein fluid damping means is provided for arresting motion of a reciprocable one of contact member.

9. A switch in accordance with claim 2 including means for preventing mechanical contact between said contact members and any other solid parts of said switch in all movements of said switch.

10. A fluid-conductor-wetted, linear relay switch including a housing, a stationary contact electrode within said housing, a reciprocable contact element, a conducting liquid, means for supporting said conducting liquid to provide a bearing surface of said liquid for supporting said contact element for reciprocation within said housing, said means for supporting and said liquid defining a predetermined space within which said element can reciprocate between open and closed switch positions relative to said electrode, said element and said electrode being electrically connected by said liquid when said element and said electrode are in a closed switch condition, said electrode and said element being mechanically spaced apart in all positions of said element, said element being held apart from said electrode in said closed condition by said liquid, a pair of stationary contact electrodes wherein said stationary contact electrodes comprise axially aligned pins, said housing defines a generally elongated cylindrical hollow space adapted for lengthwise reciprocation of said reciprocable contact element, said reciprocable contact element comprises an armature with an annular cross-section adapted to slide over said pins, and said conducting liquid comprising mercury, whereby said mercury bridges the gap between said pins and said armature when they are juxtaposed.

11. A switch in accordance with claim 10 wherein said conducting liquid comprises a mechanical bearing material for centering said reciprocable contact element within said hollow space upon support provided by said housing.

12. A switch comprising an envelope, at least two contacts, a plurality of conducting liquid layers within said envelope, each said contact having a contact surface wetted by said conducting liquid and carrying a said conducting liquid layer thereon, a movable element integral with at least one of said contact surfaces being movable towards and away from the other of said contact surfaces, said conducting liquid layers being capable of completing the electrical circuit between said contact surfaces when said contacts are operatively closed, wherein said conducting liquid layers prevent mechanical contact between said movable element and any other solid parts of said switch in any normal position of said element.

13. A fluid-conductor-wetted, linear relay switch including a housing, a stationary contact electrode within said housing, a reciprocable contact element, a high viscosity liquid, means for supporting said liquid to provide a bearing surface of said liquid for supporting said contact element for reciprocation within said housing, said means for supporting and said liquid defining a predetermined space within which said element can reciprocate between open and closed switch positions relative to said electrode, said electrode and said element being mechanically spaced apart in all positions of said element, and said element being held apart by a predetermined spacing from mechanical contact with said electrode in said closed condition by cohesive force of said liquid, said element and said electrode having conforming electrical contact surfaces adapted for confrontation during sliding of said element into said closed condition, and in said closed condition said conforming surfaces resting in side-by-side overlapping relationship with said liquid contained within the space between said conforming surfaces, said conforming surfaces extending parallel to the axis of reciprocation of said reciprocable contact element.

* * * * *